US011653811B2

(12) United States Patent
Lung

(10) Patent No.: US 11,653,811 B2
(45) Date of Patent: May 23, 2023

(54) SOAP SPONGE

(71) Applicant: Taikone Technologies Inc., Dongguan (CN)

(72) Inventor: Andrew Lung, Dongguan (CN)

(73) Assignee: Taikone Technologies Inc., Dongguan (CN)

( * ) Notice: Subject to any disclaimer, the term of this patent is extended or adjusted under 35 U.S.C. 154(b) by 623 days.

(21) Appl. No.: 16/788,002

(22) Filed: Feb. 11, 2020

(65) Prior Publication Data

US 2020/0288937 A1 Sep. 17, 2020

Related U.S. Application Data

(60) Provisional application No. 62/817,907, filed on Mar. 13, 2019.

(51) Int. Cl.

| | |
|---|---|
| ***A47L 13/00*** | (2006.01) |
| ***C11D 1/00*** | (2006.01) |
| ***A47L 13/17*** | (2006.01) |
| ***C11D 9/26*** | (2006.01) |
| ***C11D 13/16*** | (2006.01) |
| ***C11D 13/10*** | (2006.01) |
| ***C11D 17/04*** | (2006.01) |
| ***C11D 13/12*** | (2006.01) |
| ***C11D 9/02*** | (2006.01) |
| ***C11D 9/06*** | (2006.01) |
| ***C11D 10/04*** | (2006.01) |
| ***C11D 1/66*** | (2006.01) |
| ***C11D 13/08*** | (2006.01) |

(52) U.S. Cl.

CPC ..... *A47L 13/17* (2013.01); *C11D 1/662* (2013.01); *C11D 9/02* (2013.01); *C11D 9/06* (2013.01); *C11D 9/265* (2013.01); *C11D 9/267* (2013.01); *C11D 10/045* (2013.01); *C11D 13/08* (2013.01); *C11D 13/10* (2013.01); *C11D 13/12* (2013.01); *C11D 13/16* (2013.01); *C11D 17/049* (2013.01)

(58) Field of Classification Search

None

See application file for complete search history.

(56) References Cited

U.S. PATENT DOCUMENTS

| | | | | |
|---|---|---|---|---|
| 6,190,079 | B1 * | 2/2001 | Ruff | C11D 17/049 510/146 |
| 2003/0220212 | A1 * | 11/2003 | DeVitis | C11D 17/048 510/144 |
| 2004/0033915 | A1 * | 2/2004 | Aleles | A61K 8/8152 510/141 |
| 2005/0119270 | A1 * | 6/2005 | Mason | A61P 9/10 514/355 |

* cited by examiner

*Primary Examiner* — Necholus Ogden, Jr.

(74) *Attorney, Agent, or Firm* — Davidson, Davidson & Kappel, LLC

(57) ABSTRACT

The present invention is related to a sodium and potassium soap sponge and method of making it.

21 Claims, 9 Drawing Sheets

SOAP SPONGE

FIELD OF THE INVENTION

The present invention is related to a sodium and potassium soap sponge and method of making it. The soap sponge of the present invention provides a better experience to the user and allows for a massage of the body, while deep cleaning occurs. The soap sponge has internal holes which provide air for the soap, resulting in more bubbles during washing. The additional air and bubbles also give the soap a better, smoother, softer feel and the bubbles massage and gently exfoliate the outer skin of the user.

BACKGROUND OF THE INVENTION

A variety of cleansing devices that combine soaps with scrubbing brushes or sponges have been developed. The soaps provide an emulsifying action for dissolving dirt and keeping the dirt away from the skin. The scrubbing brushes and sponges add mechanical abrasive action for an initial dislodging of dirt from the skin. However, improvements to these known cleansing devices is still desirable.

For example, U.S. Pat. No. 5,857,792 describes a bar of soap in combination with a sponge for use in washing a person's body. The bar of soap is either adhesively bonded to the sponge or mechanically bonded to a plate or substrate which is in turn adhesively bonded to the sponge. The specification of the '792 patent describes melting soap, pouring the molten soap onto the first side of a substrate having anchoring projections, solidifying the soap around the projections, and adhering a sponge to the second side of the substrate. In this invention, the substrate layer (or adhesive layer) insulates the soap from the sponge, so the soap cannot be directly transferred to the sponge during use.

U.S. Pat. No. 7,348,299 is purportedly directed to a cleansing product having a water insoluble absorbent/adsorbent layer attached to a water insoluble scrubbing layer and a mild, low active, low viscosity cleansing composition contained in the absorbent/adsorbent layer. A sufficient quantity of the composition is transferred on demand to the scrubbing layer by squeezing the implement.

U.S. Pat. No. 6,187,728 is purportedly directed to a composite article comprising a solid cosmetic formulation core, preferably of transparent glycerin soap, and a foamed polymer skin, preferably a sponge. The solid soap-core is preferably formulated to mimic the meat of a fruit such as an orange. The sponge-skin is preferably formulated to mimic the skin appropriate to the meat, for example, an orange peel. At least the meat and preferably also the skin part includes dyes and fragrances to impart the color and smell of the fruit being imitated. The composite article is produced either by forming the soap core, coating a sponge forming polymeric composition onto the soap core, and foaming and curing the coating to form a sponge skin on the soap core, or by first forming a hollow foamed polymer shell, introducing liquefied soap into the shell, and hardening the soap.

U.S. Pat. No. 3,949,137 describes a gel-impregnated sponge composed of two layers: one layer is impregnated with a hardened gel material and one layer is an unimpregnated sponge, the impregnated layer having a fibrous or fur-like coating on its outer surface areas.

U.S. Pat. No. 5,221,506 describes a bar soap having a sponge core having a structural center selected from an open celled sponge material, or woven or non-woven organic filamentary material, which is preferably fully soap-impregnated. The sponge core is revealed after the soap bar is reduced to a sliver, purportedly providing support, preventing breakage and making washing more effective and reducing wastage. However, the amount of sponge available for scrubbing the skin varies with use, from no sponge available initially to all sponge and no soap at the end. Thus, for effective cleaning, a separate wash cloth or sponge is required at least initially.

U.S. Patent Application Publication No. 2003/0220212 A1 describes bar soap reinforced with a reinforcement member such as a mesh to prolong the usage of the bar.

U.S. Pat. No. 6,190,079 describes a scrubbing soap bar composed of vegetable oil and glycerin into which is partially imbedded a thin fine-mesh netting that serves as a feature to facilitate grasping and holding the soap bar.

U.S. Pat. No. 4,969,225 relates to a scrub brush specifically made to contain a bar of soap.

U.S. Pat. No. 4,190,550 describes a seamless envelope of crimped, resilient, stretchy synthetic organic fibers which surrounds a core of solid soap or other suitable surfactant material and is held in integral form solely by the interentanglement of the fibers.

U.S. Patent Application Publication No. 2004/0033915 A1 relates to cleansing bars including a cleansing composition and a plurality of discrete elements (e.g., fibers) having a length to diameter ratio of from about 50 to 1 to about 100,000 to 1.

EP Patent No. 1 266 599 A1 describes a solid cleanser holder composed of an apertured textured film surrounding a solid cleanser. The film purportedly reduces slip, exfoliates and enhances lather.

U.S. Patent Application Publication No. 2005/0113270 A1 relates to a scrubbing soap bar having a filamentous network with internal void regions and a soap material that substantially surrounds the scrubbing element and at least partially fills the void regions within the scrubbing element. The publication purportedly also includes a method of positioning a scrubbing element in a mold configured to receive the scrubbing element, adding a soap material to the mold to form a solid bar that encapsulates the scrubbing element, and removing the solid bar from the mold.

U.S. Pat. No. 6,896,435 describes a slip-resistant floating soap having two outer convex shaped layers of soap connected to an inner layer of concave-shaped rigid water-impermeable buoyant material having an exposed slip-resistant outer surface extending around the outer perimeter of the floating soap bar to provide a gripping surface for the hand of the user to aid in preventing the floating soap bar from slipping from the hands of the user.

U.S. Pat. No. 6,893,182 describes a soap device having an embedded spongy or perforated cleansing device.

The present invention seeks improvements over deficiencies in the known soap art. Among the one or more problems addressed include the development of a personal cleansing article having a better, softer feel, a higher delivery of fragrance and that is convenient and economical to use.

OBJECTS AND SUMMARY OF THE INVENTION

It is an object of the present invention to develop a sodium and potassium soap sponge that provides a better experience to the user and allows for a massage of the body, while deep cleaning occurs. It is also an object of the invention to provide a soap sponge having internal holes which provide air for the soap, resulting in more bubbles during washing and which give the soap a better, smoother, softer feel.

It is a further object of the present invention to develop a method of making a sodium and potassium soap sponge.

In accordance with the above objects and others, the present invention is directed in part to a sodium and potassium soap sponge comprising: i) a translucent soap comprising glycerinum, propranediol, sorbitol, an alkali, a foaming agent, 12 dodecanoic acid, stearic acid, CAB-35 (cocamidopropyl betaine), industrial white granulated sugar, edible alcohol, purified water, a fatty acid sodium salt and a fatty acid potassium salt; ii) a milky white soap base comprising glycerinum, propranediol, sorbitol, an alkali, a foaming agent, 12 dodecanoic acid, stearic acid, CAB-35 (cocamidopropyl betaine), industrial white granulated sugar, edible alcohol, purified water, a fatty acid sodium salt and a fatty acid potassium salt and titanium white pulp; iii) a foaming surfactant agent and iv) a sponge. In certain preferred embodiments of the present invention, the ratio of translucent soap to milky white soap is about 1:0.45.

In certain embodiments of the invention, the translucent soap is comprised of from about 1% to about 3% glycerinum, from about 2% to about 3% propranediol, from about 1% to about 2% sorbitol, from about 15% to about 20% alkali, from about 10% to about 11% foaming agent, from about 1.5% to about 3% 12 dodecanoic acid, from about 1.5% to about 3% stearic acid, from about 8% to about 20% CAB-35 (cocamidopropyl betaine), from about 3% to about 5% industrial white granulated sugar, from about 7% to about 10% of edible alcohol, from about 25% to about 30% purified water, from about 30% to about 40% fatty acid sodium salt and from about 5% to about 8% fatty acid potassium salt.

In certain embodiments, the milky white soap base is comprised of from about 1% to about 3% glycerinum, from about 2% to about 3% propranediol, from about 1% to about 2% sorbitol, from about 15% to about 20% alkali, from about 10% to about 11% foaming agent, from about 1.5% to about 3% 12 dodecanoic acid, from about 1.5% to about 3% stearic acid, from about 9% to about 20% CAB-35 (cocamidopropyl betaine), from about 3% to about 5% industrial white granulated sugar, from about 7% to about 10% of edible alcohol, from about 25% to about 30% purified water, from about 30% to about 40% fatty acid sodium salt, from about 5% to about 8% fatty acid potassium salt and from about 1% to about 2% titanium white pulp.

In certain preferred embodiments of the invention, the translucent soap is comprised of about 1% glycerinum, about 2% propranediol, about 1% sorbitol, about 15% alkali, about 10% foaming agent, about 1.5% 12 dodecanoic acid, about 1.5% stearic acid, 9% CAB-35 (cocamidopropyl betaine), about 2% industrial white granulated sugar, about 7% edible alcohol, about 15% purified water, about 30% fatty acid sodium salt and about 5% fatty acid potassium salt. In certain preferred embodiments of the invention, the milky white soap base is comprised of about 1% glycerinum, about 2% propranediol, about 1% sorbitol, about 15% alkali, about 10% foaming agent, about 1.5% 12 dodecanoic acid, about 1.5% stearic acid, about 8% CAB-35 (cocamidopropyl betaine), about 2% industrial white granulated sugar, about 7% edible alcohol, about 15% purified water, about 30% fatty acid sodium salt, about 5% fatty acid potassium salt and about 1% titanium white pulp.

In certain embodiments of the present invention, the foaming agent in the translucent soap and in the milky white soap base, and the foaming surfactant agent added to the mixture of the translucent soap and the milky white soap base is selected from e.g. pharmaceutically acceptable anionic surfactants, cationic surfactants, amphoteric (amphipathic/amphophilic) surfactants, and non-ionic surfactants.

Suitable pharmaceutically acceptable anionic surfactants include, for example, monovalent alkyl carboxylates, acyl lactylates, alkyl ether carboxylates, N-acyl sarcosinates, polyvalent alkyl carbonates, N-acyl glutamates, fatty acid-polypeptide condensates, sulfuric acid esters, alkyl sulfates (including lauryl sodium sulfate (K12)), ethoxylated alkyl sulfates, ester linked sulfonates (including docusate sodium or dioctyl sodium succinate (DSS)), alpha olefin sulfonates, and phosphated ethoxylated alcohols.

Suitable pharmaceutically acceptable cationic surfactants include, for example, monoalkyl quaternary ammonium salts, dialkyl quaternary ammonium compounds, amidoamines, and aminimides.

Suitable pharmaceutically acceptable amphoteric (amphipathic/amphophilic) surfactants, include, for example, N-substituted alkyl amides, N-alkyl betaines, sulfobetaines, and N-alkyl .beta.-aminoproprionates.

Suitable pharmaceutically acceptable wetting (solubilizing) agents, include pharmaceutically acceptable non-ionic surfactants such as, for example, polyoxyethylene compounds, ethoxylated alcohols, ethoxylated esters, ethoxylated amides, polyoxypropylene compounds, propoxylated alcohols, ethoxylated/propoxylated block polymers, and propoxylated esters, alkanolamides, amine oxides, fatty acid esters of polyhydric alcohols, ethylene glycol esters, diethylene glycol esters, propylene glycol esters, glyceryl esters, polyglyceryl fatty acid esters, sorbitan esters, sucrose esters, and glucose (dextrose) esters.

In certain embodiments of the present invention, the foaming agent or foaming surfactant agent is an alkali metal chloride, magnesium chloride, calcium chloride, organic acid such as citric, succinic, fumaric, malic, maleic, glutaric, lactic and the like, an alkali metal sulfate such as sodium sulfate, alkali metal alkyl sulfates wherein the alkyl group is from 1 to 14 carbon atoms, such as sodium methyl sulfate, lauryl sodium sulfate (K12) and the like as well as dioctyl sodium sulfosuccinate, dihydrogen sodium phosphate, monohydrogen sodium phosphate, disodium hydrogen phosphate, sodium chloride, sodium fluoride and mixtures thereof.

In certain preferred embodiments, the foaming agent is lauryl sodium sulfate (K12). In other preferred embodiments, the foaming agent is CAB-35 (cocamidopropyl betaine) or a combination of CAB-35 and lauryl sodium sulfate (K12).

In other preferred embodiments, the foaming surfactant agent is lauryl sodium sulfate (K12), CAB-35, APG2000 or combinations thereof.

In certain embodiments, the alkali is selected from the group consisting of sodium hydroxide, and potassium hydroxide. In certain preferred embodiments of the present invention, the alkali is sodium hydroxide.

In certain embodiments, the ratio of translucent soap to milky white soap base is from about 1:030 to about 1:0.60, and preferably about 1:0.45.

The invention is further directed to a method of making a sodium and potassium soap sponge comprising i) heating a translucent soap comprising glycerinum, propranediol, sorbitol, an alkali, a foaming agent, a 12 dodecanoic acid, stearic acid, CAB-35 (cocamidopropyl betaine), industrial white granulated sugar, edible alcohol, purified water, a fatty acid sodium salt and a fatty acid potassium salt until the soap is completely melted; ii) mixing in an amount of milky white soap base to the translucent soap and heating the combination until melted completely, wherein the milky white soap base comprises glycerinum, propranediol, sorbitol, an alkali, a foaming agent, 12 dodecanoic acid, stearic acid, CAB-35 (cocamidopropyl betaine), industrial white granulated sugar, edible alcohol, purified water, a fatty acid sodium salt and a fatty acid potassium salt and titanium white pulp; iii) mixing in a foaming surfactant agent to the combination of translucent soap and milky white soap base, v) pouring the mixture into a mold; vi) placing a sponge into the mold containing the soap and allowing the soap to sink into the sponge; vii) cooling the molds containing the soap and sponge until the soap is solid and removing the sodium and potassium soap sponge from the mold.

In certain preferred embodiments, a coloring agent and/or a flavoring agent is added to the mixture before or after the addition of the foaming surfactant agent in step iii above. In certain preferred embodiments, a coloring agent and/or a flavoring agent is added after the mixing of the foaming surfactant agent with the combination of the translucent soap and the milky white soap.

In certain embodiments, the ratio of translucent soap to milky white soap base is from about 1:030 to about 1:0.60, and preferably about 1:0.45.

In preferred embodiments, the amount of foaming surfactant agent is about 1% to about 10% of the total mixture, more preferably about 1% to about 4% of the total mixture and most preferably about 2% of the total mixture.

In certain embodiments, the transparent soap is heated to a temperature of from about 90° C. to about 110° C. for a time period from about 8 to about 8.5 minutes. In certain preferred embodiments, the soap is heated to a temperature of about 100° C. for about 8 minutes until the soap had been melted.

In certain embodiments, the combination of the transparent soap and the milky white soap base is heated in a microwave to a temperature of from about 90° C. to about 110° C. for a time period from about 5 to about 7 minutes. In certain preferred embodiments, the mixture is heated for about 6 minutes to a temperature of about 97.3° C. until the soap had been melted completely.

In certain embodiments, the foaming surfactant agent is lauryl sodium sulfate (K12).

In certain embodiments of the present invention, the foaming surfactant agent is mixed in with the transparent and milky soaps for from about 5 to about 7 seconds at a temperature of about 95° C. to about 100° C. In certain preferred embodiments, the mixture is heated for about 6 seconds at a temperature of about 97° C.

In certain preferred embodiments, the bottom of the mold is scraped after the mixture is poured into the mold to avoid air bubbles.

In certain preferred embodiments, a portion of the sponge does not contact the mixture that has been poured into the mold. In most preferred embodiments, 4 mm of the sponge does not contact the mixture.

In certain embodiments of the present invention, the molds containing the mixture and sponge are placed in a refrigerator for cooling at 15° C. for 2 hours and until the soap is solid. In certain preferred embodiments, immediately after removing the mold from the refrigerator, the soap sponge is removed from the mold and wrapped with a plastic film to avoid deterioration.

It is a further object for the foaming surfactant agent added to the mixture of the translucent soap and the milky white soap base to be APG2000.

DETAILED DESCRIPTION OF THE INVENTION

Figure 1A:
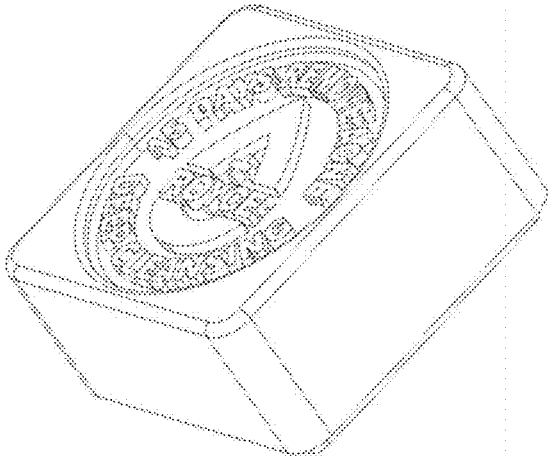
FIG. 1*a* is a drawing showing an axonometric view of the soap sponge and FIG. 1*b* is a photograph showing an axonometric view of the soap sponge.
Figure 1B:
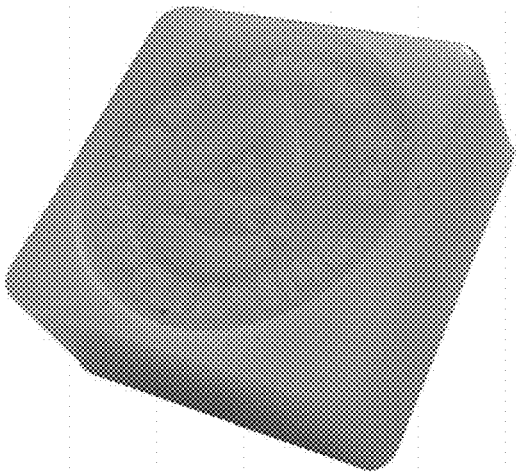
Figure 2A:
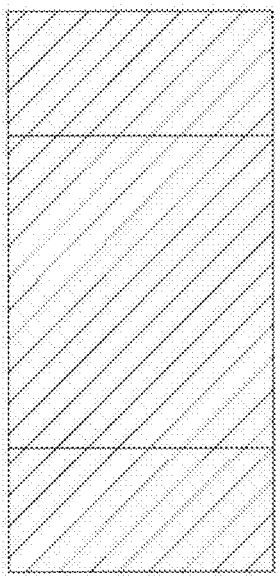
FIG. 2*a* is a drawing of the soap sponge seen from the right side viewpoint and FIG. 2*b* is a photograph showing the right side of the soap sponge.
Figure 2B:
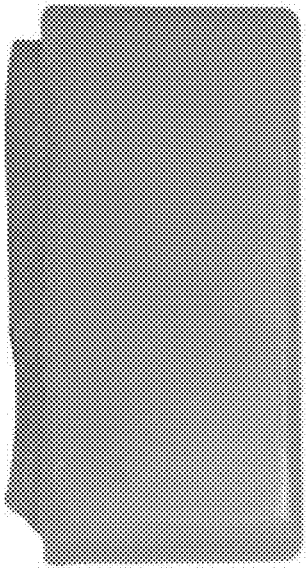
Figure 3A:
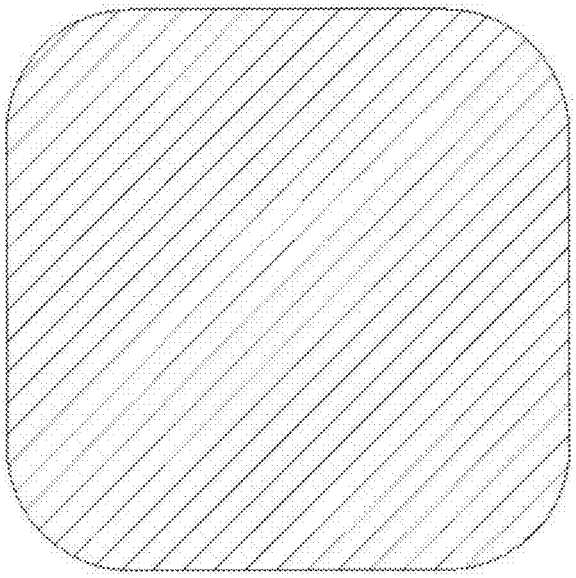
FIG. 3*a* is a drawing of the soap sponge showing a bottom view and FIG. 3*b* is a photograph showing a bottom view of the soap sponge.
Figure 3B:
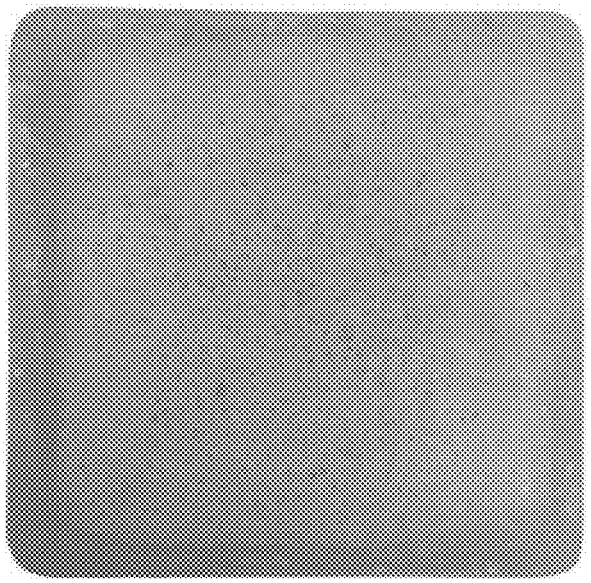
Figure 4A:
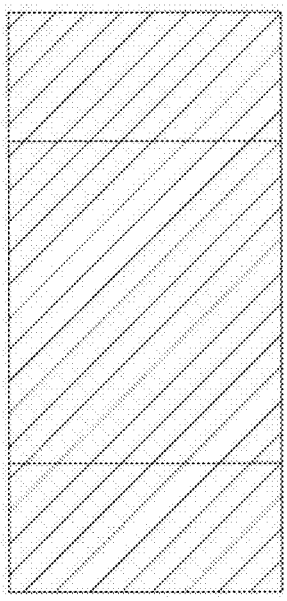
FIG. 4*a* is a drawing of the soap sponge seen from the left side viewpoint and FIG. 4*b* is a photograph showing the left side of the soap sponge.
Figure 4B:
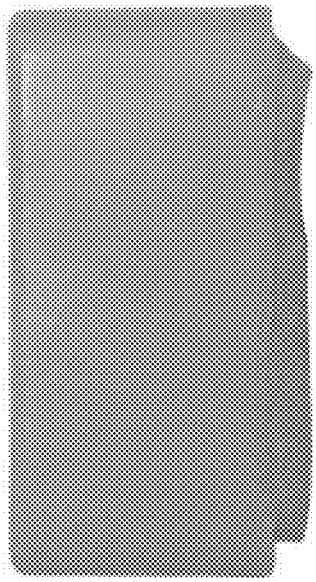
Figure 5A:
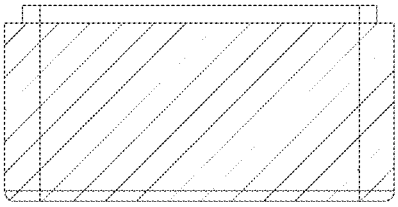
FIG. 5*a* is a drawing of the soap sponge seen from the front viewpoint and with the top of the soap sponge facing downward and FIG. 5*b* is a photograph showing a front view of the soap sponge.
Figure 5B:
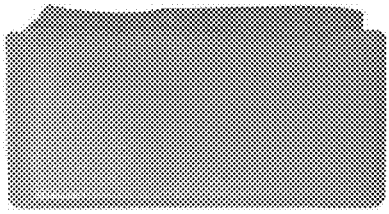
Figure 6A:
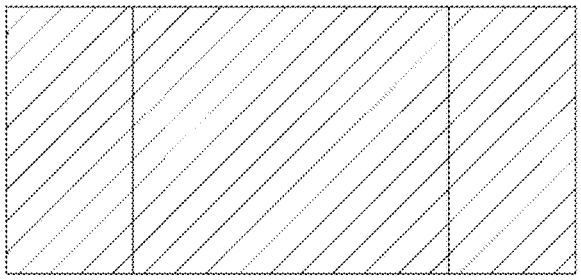
FIG. 6*a* is a drawing of the soap sponge seen from the rear viewpoint and FIG. 6*b* is a photograph showing a rear view of the soap sponge.
Figure 6B:
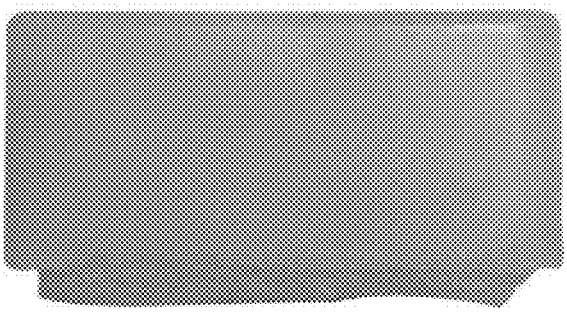
Figure 7:
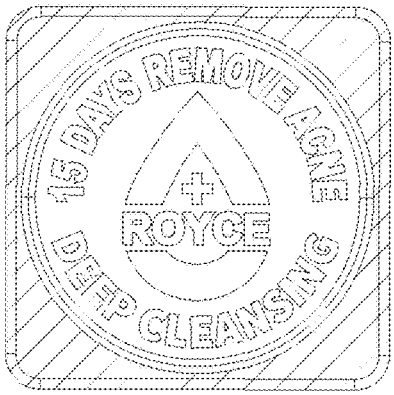
FIG. 7 is a top view of a soap sponge mold showing a logo indentation in the inner recess of the mold.
Figure 8:
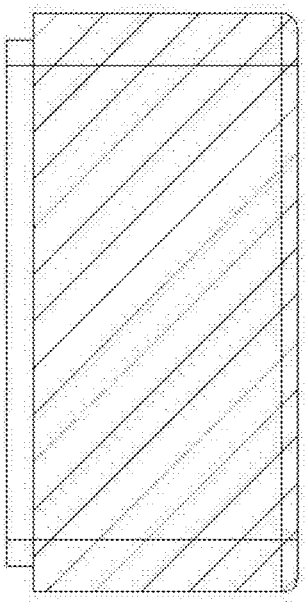
FIG. 8 is a left side view of a soap sponge mold.
Figure 9:
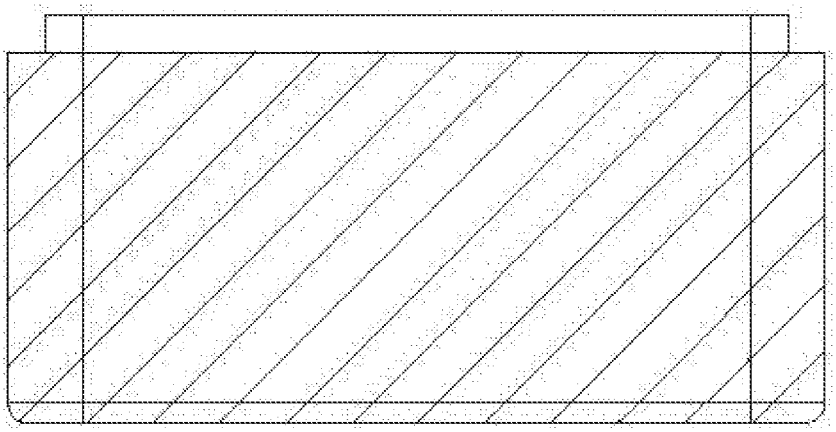
FIG. 9 is a front view of a soap sponge mold.
Figure 10:
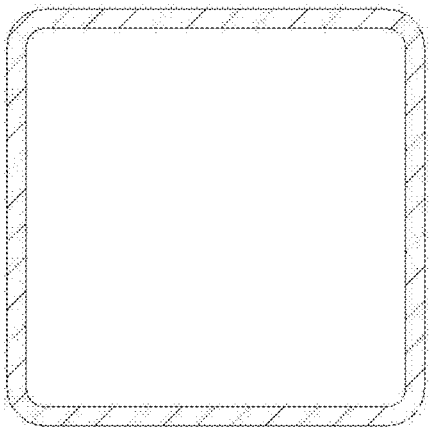
FIG. 10 is a bottom view of a soap sponge mold
Figure 11:
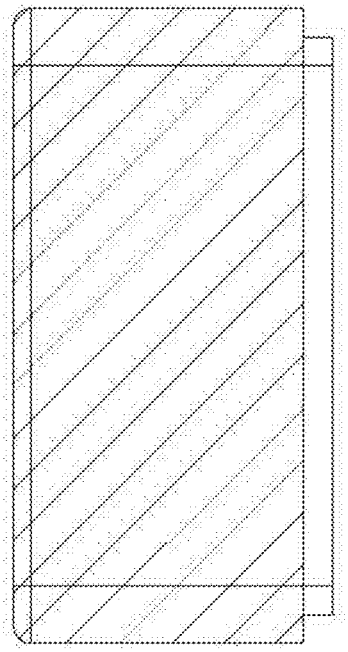
FIG. 11 is a right side view of a soap sponge mold
Figure 12:
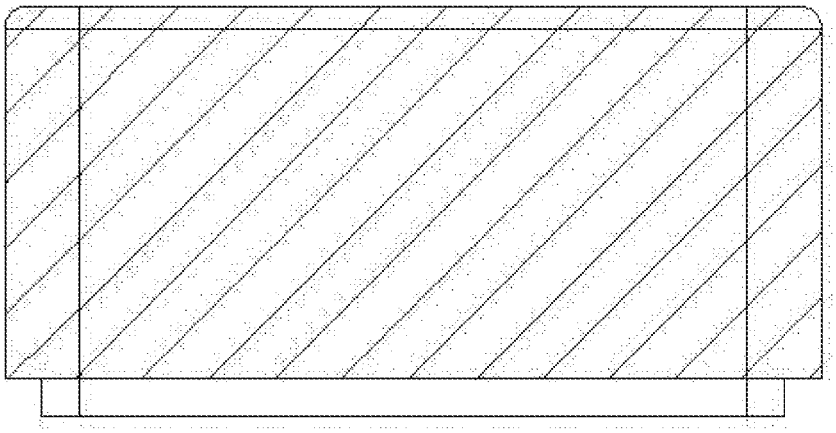
FIG. 12 is a back view of a soap sponge mold
Figure 13:
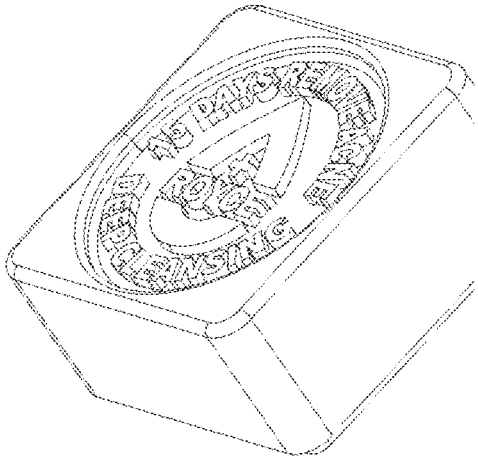
FIG. 13 shows an axonometric view of the soap sponge mold that is filled with a soap sponge from the viewpoint of the bottom of the mold.
Figure 14A:
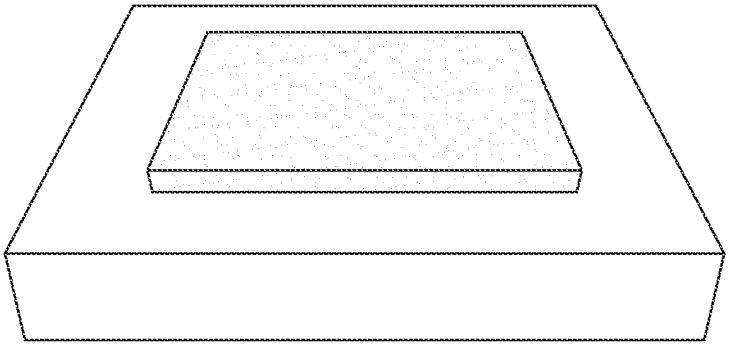
FIG. 14*a* is a photograph showing a perspective view of a mold containing a soap sponge showing the sponge having a slight portion not contacting the mixture of the soap after it is poured into the mold.
Figure 14B:
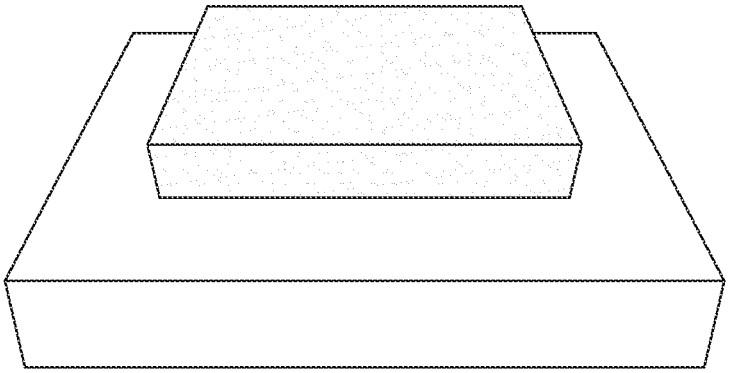
FIG. 14*b* is a photograph showing a perspective view of a mold containing a soap sponge and showing the sponge contacting the soap mixture before the sponge is pressed into the mold and the soap has solidified.
Figure 15A:
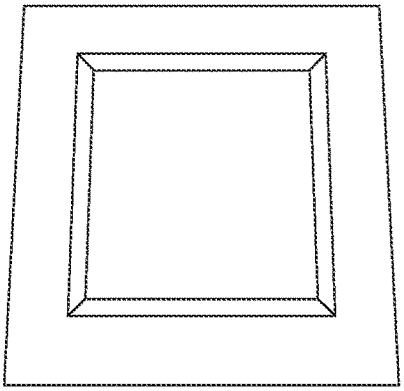
FIG. 15*a*-15*e* show examples of suitable molds for use in the present invention.
Figure 15B:
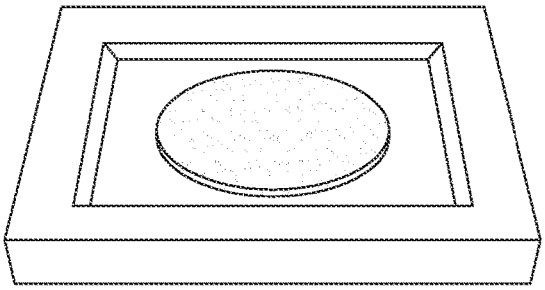
Figure 15C:
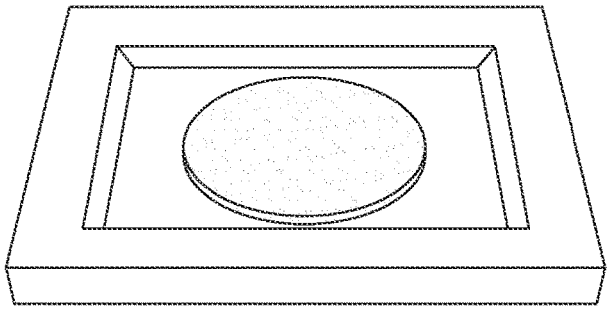
Figure 15D:
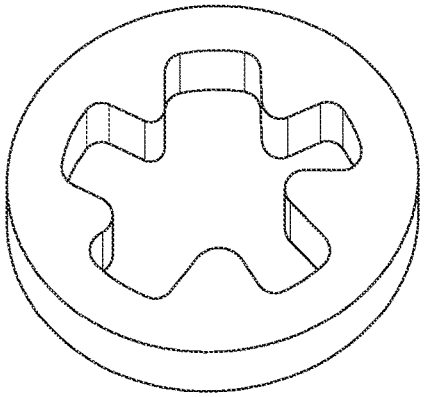
Figure 15E:
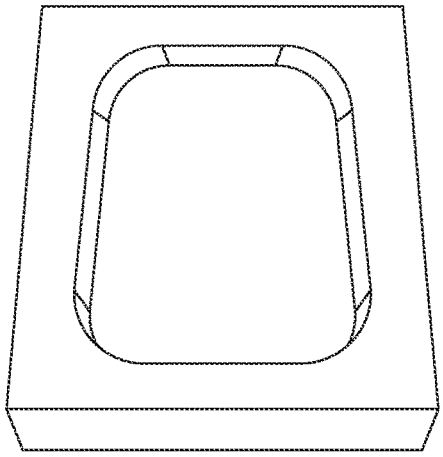

The sodium and potassium soap sponge of the present invention is formed by combining two different soaps, a translucent soap and a milky soap and then pouring the soap combination into a mold, after which a sponge is placed into the mold. The soap and sponge filled molds are then cooled until solid, after which they can be wrapped in e.g. plastic wrap to avoid deterioration and for distribution.

The translucent soap is comprised of the following ingredients: glycerinum, propranediol, sorbitol, an alkali, a foaming agent such as lauryl sodium sulfate (K12), 12 dodecanoic acid, stearic acid, CAB-35 (cocamidopropyl betaine), Industrial white granulated sugar, edible alcohol, purified water, a fatty acid sodium salt, a fatty acid potassium salt.

In certain embodiments of the invention, the translucent soap is comprised of from about 1% to about 3% glycerinum, from about 2% to about 3% propranediol, from about 1% to about 2% sorbitol, from about 15% to about 20% alkali, from about 10% to about 11% foaming agent, from about 1.5% to about 3% 12 dodecanoic acid, from about 1.5% to about 3% stearic acid, about 20% CAB-35 (cocamidopropyl betaine), about 5% industrial white granulated sugar, about 7% to about 10% of edible alcohol, about 30% purified water, about 30% to about 40% fatty acid sodium salt and about 5% to about 8% fatty acid potassium salt and the milky white soap base is comprised of from about 1% to about 3% glycerinum, from about 2% to about 3% propranediol, from about 1% to about 2% sorbitol, from about 15% to about 20% alkali, from about 10% to about 11% foaming agent, from about 1.5% to about 3% 12 dodecanoic acid, from about 1.5% to about 3% stearic acid, about 20% CAB-35 (cocamidopropyl betaine), about 5% industrial white granulated sugar, about 7% to about 10% of edible alcohol, about 30% purified water, about 30% to about 40% fatty acid sodium salt, from about 5% to about 8% fatty acid potassium salt and from about 1% to about 2% titanium white pulp. In certain preferred embodiments of the invention, the translucent soap is comprised of about 1% glycerinum, about 2% propranediol, about 1% sorbitol, about 15% alkali, about 10% foaming agent, about 1.5% 12 dodecanoic acid, about 1.5% stearic acid, 9% CAB-35 (cocamidopropyl betaine), about 2% industrial white granulated sugar, about 7% edible alcohol, about 15% purified water, about 30% fatty acid sodium salt and about 5% fatty acid potassium salt and wherein the milky white soap is comprised of about 1% glycerinum, about 2% propranediol, about 1% sorbitol, about 15% alkali, about 1.5% foaming agent, about 1.5% 12 dodecanoic acid, about 1.5% stearic acid, about 8% CAB-35 (cocamidopropyl betaine), about 2% industrial white granulated sugar, about 7% edible alcohol, about 15% purified water, about 30% fatty acid sodium salt, about 5% fatty acid potassium salt and about 1% titanium white pulp.

In certain embodiments of the present invention, the foaming agent in the translucent soap and in the milky white soap base is sodium lauryl sulfate.

The fatty acid sodium salt and fatty acid potassium salt in both the translucent soap and the milky white soap base can be any fatty acid sodium salt and fatty acid potassium salt. Both the fatty acid sodium salt and fatty acid potassium salt provide strong decontamination ability. Suitable fatty acid sodium salts for use in the present application include sodium hexanoate, sodium decanoate, sodium heptanoate, sodium hexanoate, sodium laurate, sodium linoleate, monosodium maleate trihydrate, sodium myristate, sodium nonanoate, sodium n-octanoate, sodium oleate, sodium palmitate, sodium propionate, sodium ricinolate, sodium sorbate, sodium stearate, and sodium butyrate. In preferred embodiments, the fatty acid salt is sodium laurate. A suitable fatty acid potassium salt for use in the present invention is potassium hydroxide.

An alkali is defined as a basic, ionic salt of an alkali metal or alkaline earth metal chemical element. An alkali also can be defined as a base that dissolves in water. A solution of a soluble base has a pH greater than about 7.0. In certain embodiments, the alkali is a non-metal alkali.

The alkali used in the translucent soap and in the milky white soap base can be selected from the group consisting of sodium hydroxide, and potassium hydroxide, calcium hydroxide, magnesium hydroxide, ammonia, tertiary sodium phosphate, diethanolamine, ethylenediamine, N-methylglucamine, or L-lysine and/or mixtures thereof and combinations thereof. In certain preferred embodiments of the present invention, the alkali is sodium hydroxide.

In certain embodiments, propylene glycol can be used in place of propanediol.

Table A below shows an example of preferred percentages of the ingredients in the translucent soap, ingredients in the milky white soap base and of ingredients in the mixture of the translucent and milky white soaps and further added ingredients.

TABLE A

| chemical components name | Transparent soap base | Milky white soap base | Mixture of transparent soap base and milky white soap base with additional foaming agent and color added |
|---|---|---|---|
| glycerinum | 1% | 1% | 0.98% |
| propanediol | 2% | 2% | 1.96% |
| sorbitol | 1% | 1% | 0.98% |
| alkali | 15% | 15% | 14.70% |
| lauryl sodium sulfate (K12) | 10% | 10% | 9.8% |
| 12 dodecanoic acid | 1.5% | 1.5% | 1.47% |
| stearic acid | 1.5% | 1.5% | 1.47% |
| CAB-35 (cocamidopropyl betaine) | 9% | 8% | 8.51% |
| industrial white granulated sugar | 2% | 2% | 1.96% |
| edible alcohol | 7% | 7% | 6.86% |
| purified water | 15% | 15% | 14.7% |
| fatty acid sodium salt | 30% | 30% | 29.4% |
| fatty acid potassium salt | 5% | 5% | 4.9% |
| titanium white pulp | 0% | 1% | 0.31% |
| foaming agent (APG2000) | | | 1.96% |
| Color | | | 0.03% |

The present invention is further directed to a method of making a sodium and potassium soap sponge comprising i) heating a translucent soap comprising glycerinum, propranediol, sorbitol, an alkali, a foaming agent, 12 dodecanoic acid, stearic acid, CAB-35 (cocamidopropyl betaine), industrial white granulated sugar, edible alcohol, purified water, a fatty acid sodium salt and a fatty acid potassium salt until the soap is completely melted; ii) mixing an amount of milky white soap base in with the translucent soap and heating the combination until melted completely wherein the milky white soap base comprises glycerinum, propranediol, sorbitol, an alkali, a foaming agent, 12 dodecanoic acid, stearic acid, CAB-35 (cocamidopropyl betaine), industrial white granulated sugar, edible alcohol, purified water, a fatty acid sodium salt and a fatty acid potassium salt and titanium white pulp; and wherein the ratio of translucent soap to milky white soap base is about 1:0.45; iii) mixing in a foaming surfactant agent to the combination of translucent soap and milky white soap base, wherein the amount of foaming surfactant agent is 2% of the total mixture; iv) adding a coloring agent and/or a flavoring agent to the mixture and then further mixing; v) pouring the mixture into a mold; vi) placing a sponge into the mold containing the soap and allowing the soap to sink into the sponge; vii) cooling the molds containing the soap and sponge until the soap is solid and removing the sodium and potassium soap sponge from the mold.

The transparent soap is heated until melted. In certain embodiments, the heating is carried out in a microwave, with the soap being heated for about 8 minutes at a temperature of about 100° C.

After the transparent soap has been melted, the milky white soap base is mixed in. The combination of the transparent soap and the milky white soap base is then heated until the mixture is completely melted. In certain embodiments, the heating is carried out in a microwave for about 6 minutes at a temperature of about 97.3° C.

After the mixture of soaps is completely melted, a foaming surfactant agent is mixed in with the transparent and milky soaps. The mixture is heated after the foaming surfactant agent is added in. Preferably, the heating is by microwave for about 6 seconds at about 97° C.

In certain embodiments of the present invention, a coloring agent and/or fragrance are added to translucent soap/milky white soap base/foaming surfactant mixture. Preferred fragrances include sea & rose, forest, volcanic mud, bamboo carbon, green tea flavor.

The mixture is then poured into a mold. The molds used in the present invention can be of any size and shape desired and of a variety of materials known to those of skill in the art. For example, the molds can be made of silicone, ethylene vinyl acetate copolymer or polypropylene In preferred embodiments of the present invention, the molds are not completely filled with the mixture to allow room for the placement of the sponge in the mixture without overflow of the mixture.

In certain embodiments, the bottom of the mold is scraped as the mixture is poured in to avoid air bubbles. A sponge is then placed in the soap filled mold before the soap solidifies, with a portion of the sponge left out of the soap. The sponge can e.g. be a hydrophilic polyurethane sponge manufactured in the manner detailed below or in another suitable manner known to those of skill in the art. In most preferred embodiments, about 4 mm of the sponge is left out of the soap after solidity.

The molds containing the soap and sponge are then cooled until the soap is solid. In preferred embodiments, the molds can be placed in a refrigerator for cooling at 15° C. for 2 hours and until the soap is solid. In certain preferred embodiments, immediately after removing the mold from the refrigerator, the soap sponge is removed from the mold and wrapped with a plastic film to avoid deterioration.

The sponges used for the present invention can be standard sponges used with sponges. Alternatively, sponges can be specifically manufactured for the sodium and potassium soap sponge. For example a preferred sponge is made of hydrophilic polyurethane. The sponges are cut and shaped to fit the desired mold shapes and sizes. Preferably, the sponges are from 55 mm×55 mm to 95 mm×67 mm.

In certain embodiments, the molds are slightly bigger in dimension than the sponges. In certain preferred embodiments the molds range in size from about 60 mm×about 60 mm to about about 100 mm×about 72 mm.

DETAILED DESCRIPTION OF THE PREFERRED EMBODIMENTS

The following examples are not meant to be limiting and represent certain embodiments of the present invention.

Example 1: Transparent Soap Base

A transparent soap base is made by blending the following ingredients one by one in the order listed below by machine mixing the ingredients while heating the mixture to a temperature of about 70° C. In certain embodiments, the ingredients are added one by one in the order listed below.

TABLE B

| Chemical components name | percentage | Example 1320G |
|---|---|---|
| glycerinum | 1% | 13.2 |
| propanediol | 2% | 26.4 |
| sorbitol | 1% | 13.2 |
| alkali | 15% | 198 |
| lauryl sodium sulfate (K12) | 10% | 132 |
| 12 dodecanoic acid | 1.5% | 19.8 |

TABLE B-continued

| Chemical components name | percentage | Example 1320G |
|---|---|---|
| stearic acid | 1.5% | 19.8 |
| CAB-35 (cocamidopropyl betaine) | 9% | 118.8 |
| industrial white granulated sugar | 2% | 26.4 |
| edible alcohol | 7% | 92.4 |
| purified water | 15% | 198 |
| fatty acid sodium salt | 30% | 396 |
| fatty acid potassium salt | 5% | 66 |

Example 2: Milky White Soap Base

A milky white soap base is made by blending the following ingredients one by one in the order listed below by machine mixing the ingredients while heating the mixture to a temperature of about 70° C.

TABLE C

| chemical components name | percentage | Example 600G |
|---|---|---|
| glycerinum | 1% | 6 |
| propanediol | 2% | 12 |
| sorbitol | 1% | 6 |
| alkali | 15% | 90 |
| lauryl sodium sulfate (K12) | 10% | 60 |
| 12 dodecanoic acid | 1.5% | 9 |
| stearic acid | 1.5% | 9 |
| CAB-35 (cocamidopropyl betaine) | 8% | 48 |
| Industrial white granulated sugar | 2% | 12 |
| edible alcohol | 7% | 42 |
| purified water | 15% | 90 |
| Fatty acid sodium salt | 30% | 180 |
| Fatty acid potassium salt | 5% | 30 |
| Titanium white pulp | 1% | 6 |

Example 3: Sponge

An example of a suitable hydrophilic polyurethane sponge for use in the present invention is prepared by combining a coupling agent (e.g. silane (sulfane)), an open cell agent (e.g. pluronic), an anti-mould agent (e.g IPBC-II), an antiseptic (e.g. diazolidinylurea), a functional filler and whitening effect (rutile titanium dioxide) and polyurethane prepolymer. An example showing the amount of each ingredient that can be used to prepare a suitable sponge for use with the present invention is set out in Table D below, although one of skill in the art would understand alternate ingredients and amounts that would also be suitable.

TABLE D

| Chemical | CAS.NO | purpose | Percentage |
|---|---|---|---|
| Silane(sulfane) | 7803-62-5 | coupling agent | 0.67% |
| pluronic | 9003-11-6 | Open Cell Agent | 0.81% |
| IPBC-II | 55406-53-6 | Anti-mould Agent | 0.67% |
| Diazolidinylurea | 78491-02-8 | Antiseptic | 1.34% |
| Rutile Titanium Dioxide | 13463-67-7 | Functional filler& Whitening effect | 6.73% |
| Polyurethane prepolymer | 26471-62-5 | Foaming | 89.78% |

Example 4: Production of Sodium and Potassium Soap Sponge 1320 grams of the transparent soap from Example 1 are heated in a microwave for 8 minutes at a temperature of 100°

C. so that the transparent soap is completely melted. 600 grams of the milky white soap base from Example 2 are then mixed in with melted transparent soap and the mixture is then heated in a microwave for about 6 minutes at a temperature of about 97.3° C. so that both the milky and transparent soaps are melted completely.

The mixture is then removed from the microwave and 39 grams of APG2000, a foaming surfactant agent is added to mixture of the transparent and milky soaps and then the mixture is heated in a microwave for about 6 seconds at about 97° C.

39 grams of forest flavor are added to the mixture, after which 1.1 grams of CO15, a green pigment color is added. The mixture is then mixed for about 11 seconds at a temperature of about 82.7° C. The temperature can be measured by e.g. the use of a temperature measuring gun.

Twelve grams of the mixture is next poured into each mold (with the mold having a height of about 25 mm), after which the bottom of each mold is scraped to prevent air bubbles from appearing in the soap. In certain embodiments, a rubber or silicone device is used to scrape the bottom of each mold. More of the mixture is then slowly poured into the mold to the desired height. In certain embodiments, the mixture is contained in and is slowly poured into the mold from a glass flask to eliminate bubbles, particularly at any desired area that should have a smooth surface, such as a logo area.

A sponge is then placed into each individual mold and the soap is allowed to sink into the sponge. Approximately 4 mm of the sponge should remain above the top level of the soap. The molds containing the soap and sponge are them placed in a refrigerator for cooling at at approximately 15° C. for about 2 hours and until the soap is solid.

Immediately after removing the mold from the refrigerator, the soap sponge is removed from the mold and wrapped with a plastic film to avoid deterioration.

CONCLUSION

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A sodium and potassium soap sponge comprising a translucent soap comprising glycerinum, propranediol, sorbitol, an alkali, a foaming agent, 12 dodecanoic acid, stearic acid, CAB-35 cocamidopropyl betaine, industrial white granulated sugar, edible alcohol, purified water, a fatty acid sodium salt and a fatty acid potassium salt;

a milky white soap base comprising glycerinum, propranediol, sorbitol, an alkali, a foaming agent, 12 dodecanoic acid, stearic acid, CAB-35 cocamidopropyl betaine, industrial white granulated sugar, edible alcohol, purified water, a fatty acid sodium salt and a fatty acid potassium salt and titanium white pulp;

a foaming surfactant agent;

a sponge which is partially embedded in a mixture of the translucent soap, the milky white soap base and the foaming surfactant agent.

2. The soap sponge of claim 1, wherein the foaming agent in the translucent soap is selected from the group consisting of lauryl sodium sulfate K12 and CAB-35 cocamidopropyl betaine, wherein the foaming agent in the milky white soap base is selected from the group consisting of lauryl sodium sulfate K12 and CAB-35 cocamidopropyl betaine and the foaming surfactant agent is selected from the group consisting of lauryl sodium sulfate K12, CAB-35 cocamidopropyl betaine and APG2000 decyl glucoside.

3. The soap sponge of claim 1, wherein the translucent soap is comprised of from about 1% to about 3% glycerinum, from about 2% to about 3% propranediol, from about 1% to about 2% sorbitol, from about 15% to about 20% alkali, from about 10% to about 11% foaming agent, from about 1.5% to about 3% 12 dodecanoic acid, from about 1.5% to about 3% stearic acid, about 20% CAB-35 cocamidopropyl betaine, about 5% industrial white granulated sugar, about 7% to about 10% of edible alcohol, about 30% purified water, about 30% to about 40% fatty acid sodium salt and about 5% to about 8% fatty acid potassium salt and wherein the milky white soap base is comprised of from about 1% to about 3% glycerinum, from about 2% to about 3% propranediol, from about 1% to about 2% sorbitol, from about 15% to about 20% alkali, from about 10% to about 11% foaming agent, from about 1.5% to about 3% 12 dodecanoic acid, from about 1.5% to about 3% stearic acid, about 20% CAB-35 cocamidopropyl betaine, about 5% industrial white granulated sugar, about 7% to about 10% of edible alcohol, about 30% purified water, about 30% to about 40% fatty acid sodium salt, from about 5% to about 8% fatty acid potassium salt and from about 1% to about 2% titanium white pulp.

4. The soap sponge of claim 1, wherein the translucent soap is comprised of about 1% glycerinum, about 2% propranediol, about 1% sorbitol, about 15% alkali, about 10% foaming agent, about 1.5% 12 dodecanoic acid 12 acid, about 1.5% stearic acid 18 acid, 9% CAB-35 cocamidopropyl betaine, about 2% industrial white granulated sugar, about 7% edible alcohol, about 15% purified water, about 30% fatty acid sodium salt and about 5% fatty acid potassium salt and wherein the milky white soap base is comprised of about 1% glycerinum, about 2% propranediol, about 1% sorbitol, about 15% alkali, about 10% foaming agent, about 1.5% 12 dodecanoic acid 12 acid, about 1.5% stearic acid 18 acid, about 8% CAB-35 cocamidopropyl betaine, about 2% industrial white granulated sugar, about 7% edible alcohol, about 15% purified water, about 30% fatty acid sodium salt, about 5% fatty acid potassium salt and about 1% titanium white pulp.

5. The soap sponge of claim 1, wherein the alkali is selected from the group consisting of sodium hydroxide, and potassium hydroxide.

6. The soap sponge of claim 1, wherein the foaming agent is lauryl sodium sulfate K12.

7. The soap sponge of claim 1, where the ratio of translucent soap to milky white soap is about 1:0.45.

8. A method of making a sodium and potassium soap sponge comprising a) heating a translucent soap comprising glycerinum, propranediol, sorbitol, an alkali, a foaming agent, 12 dodecanoic acid, stearic acid, CAB-35 cocamidopropyl betaine, industrial white granulated sugar, edible alcohol, purified water, a fatty acid sodium salt and a fatty acid potassium salt until the soap is completely melted;

b) mixing in an amount of milky white soap base with the translucent soap and heating the combination until melted completely wherein the milky white soap base comprises glycerinum, propranediol, sorbitol, an alkali, a foaming agent, 12 dodecanoic acid, stearic acid, CAB-35 cocamidopropyl betaine, industrial white granulated sugar, edible alcohol, purified water, a fatty acid sodium salt and a fatty acid potassium salt and titanium white pulp; and wherein the ratio of translucent soap to milky white soap base is from about 1:030 to about 1:0.60;

c) mixing in a foaming surfactant agent to the combination of translucent soap and milky white soap base, wherein the amount of foaming surfactant agent is from about 1% to about 3% of the total mixture;

d) adding an agent selected from the group consisting of a coloring agent, a flavoring agent, and combinations thereof to the mixture and then further mixing;

e) pouring the mixture into a mold;

f) placing a sponge into the mold containing the mixture and allowing the mixture to sink into the sponge;

g) cooling the mold containing the mixture and the sponge until the mixture is solid and removing the soap sponge from the mold.

9. The method of claim 7, wherein the transparent soap is heated in a microwave for about 8 minutes at a temperature of about 100° C.

10. The method of claim 7, wherein the combination of the transparent soap and the milky white soap is heated in a microwave for about 6 minutes at a temperature of about 97.3° C.

11. The method of claim 7, wherein the foaming agent is lauryl sodium sulfate K12.

12. The method of claim 7, wherein the foaming surfactant agent is mixed in with the transparent and milky soaps for about 6 seconds at about 97° C.

13. The method of claim 7, wherein an agent selected from the group consisting of a flavoring agent, a coloring agent, and combinations thereof are added to the mixture.

14. The method of claim 7, wherein the bottom of the mold is scraped after the mixture is poured into the mold to avoid air bubbles.

15. The method of claim 7, wherein a portion of the sponge does not contact the mixture.

16. The method of claim 7, wherein the mold containing the mixture and the sponge is placed in a refrigerator for cooling at about 15° C. for about 2 hours or until the soap is solid.

17. The method of claim 15, wherein after the mold is removed from the refrigerator, the soap sponge is removed from the mold and is then wrapped with a plastic film to avoid deterioration.

18. The method of claim 7, wherein the foaming surfactant agent added to the mixture of the transparent and milky soaps is APG2000 decyl glucoside.

19. The soap sponge of claim 1, wherein the foaming surfactant agent is APG2000 decyl glucoside.

20. The method of claim 7, wherein the ratio of translucent soap to milky white soap base is about 1:0.45.

21. A method of making a sodium soap sponge comprising a) heating a translucent soap comprising glycerinum, propranediol, sorbitol, an alkali, a foaming agent, 12 dodecanoic acid, stearic acid, CAB-35 cocamidopropyl betaine, industrial white granulated sugar, edible alcohol, purified water, a fatty acid sodium salt and a fatty acid potassium salt until the soap is completely melted;

b) mixing in an amount of milky white soap with the translucent soap and heating the combination until melted completely wherein the milky white soap comprises glycerinum, propranediol, sorbitol, an alkali, a foaming agent, 12 dodecanoic acid, stearic acid, CAB-35 cocamidopropyl betaine, industrial white granulated sugar, edible alcohol, purified water, a fatty acid sodium salt and a fatty acid potassium salt and titanium white pulp and wherein the ratio of translucent soap to milky white soap base is about 1:0.45;

c) mixing in a foaming surfactant agent to the combination of translucent soap and milky white soap base, wherein the amount of foaming surfactant agent is about 2% of the total mixture;

d) adding an agent selected from the group consisting of a coloring agent, a flavoring agent, and combinations thereof to the mixture and then further mixing;

e) pouring the mixture into a mold f) placing a sponge into the mold containing the soap and allowing the soap to sink into the sponge, wherein a portion of the sponge is not embedded within the soap;

g) cooling the mold containing the mixture and the sponge until the mixture is solid and removing the soap sponge from the mold.

* * * * *